United States Patent [19]

DiFrancesco et al.

[11] Patent Number: 4,661,906

[45] Date of Patent: Apr. 28, 1987

[54] BINGO GAME CALCULATOR WITH IMPROVED PROCESSING

[76] Inventors: Joseph C. DiFrancesco, 238 Oakdale Ave., Horsham, Pa. 19044; Adelbert M. Gillen, 1 Cornwell Dr., New Hope, Pa. 18938

[21] Appl. No.: 624,237

[22] Filed: Jun. 25, 1984

[51] Int. Cl.[4] ..... A63F 3/00; A63F 3/06

[52] U.S. Cl. ..... 364/410; 273/269

[58] Field of Search ..... 364/410, 412; 273/138 A, 148 R, 269

[56] References Cited

U.S. PATENT DOCUMENTS

| | | | |
|---|---|---|---|
| 4,121,830 | 10/1978 | Buckley | 273/138 A |
| 4,323,770 | 4/1982 | Dieblot et al. | 364/412 |
| 4,332,389 | 6/1982 | Loyd, Jr. et al. | 273/138 A |
| 4,436,308 | 3/1984 | Rose et al. | 273/138 A |
| 4,475,157 | 10/1984 | Bolan | 364/410 |
| 4,500,091 | 2/1985 | Rovsek | 273/148 R |

*Primary Examiner*—Jerry Smith
*Assistant Examiner*—Kimthanh Bui
*Attorney, Agent, or Firm*—Ferrill and Logan

[57] ABSTRACT

A minicomputer system is built-up and customized to monitor and analyze bingo game play entered into the system according to a soft-wired processing sequence, allowing a player to simultaneously play a large number of bingo cards with user friendly communication and announcements of near bingo and bingo wins, whereof the processor stores a large number of different entered bingo cards, a bingo game pattern to be played and analyzes and stores entered bingo "called" numbers and determines a "win".

14 Claims, 16 Drawing Figures

FIG. 1.
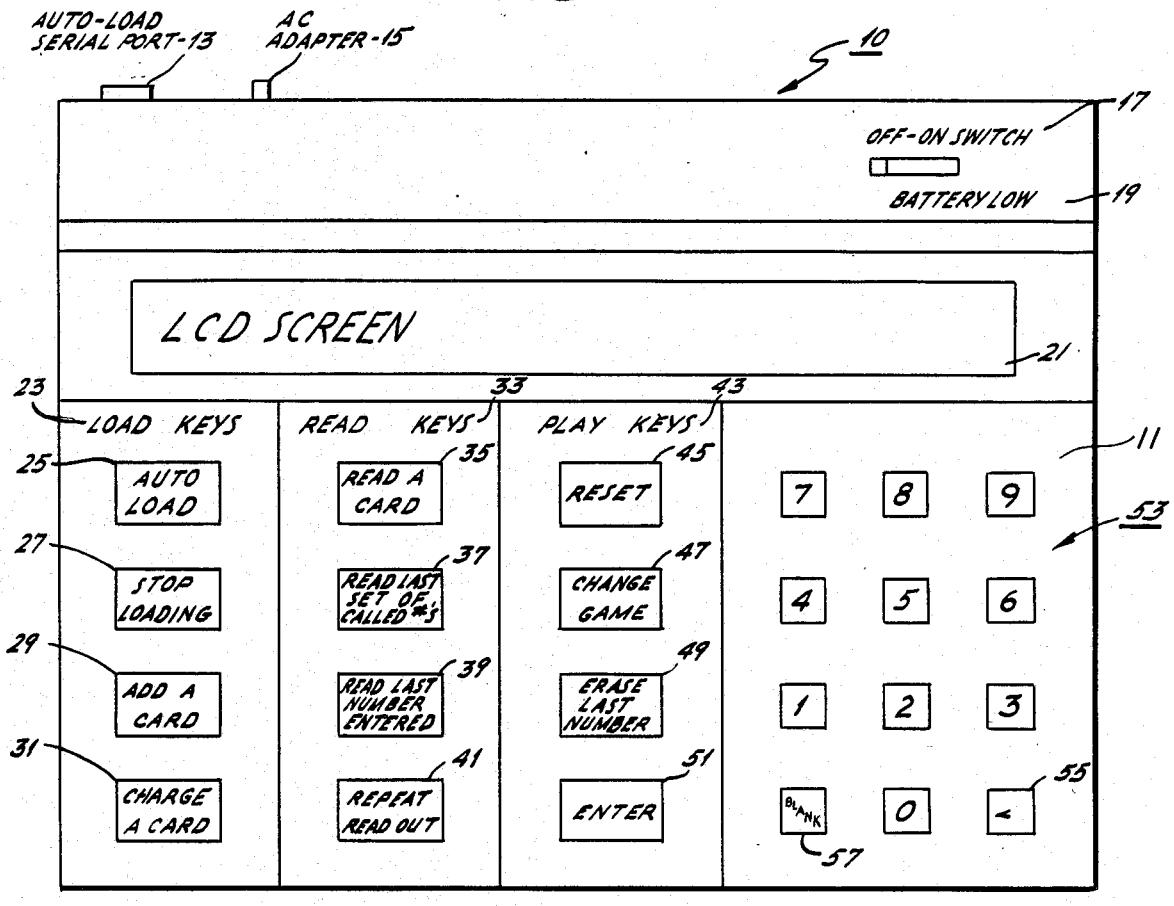
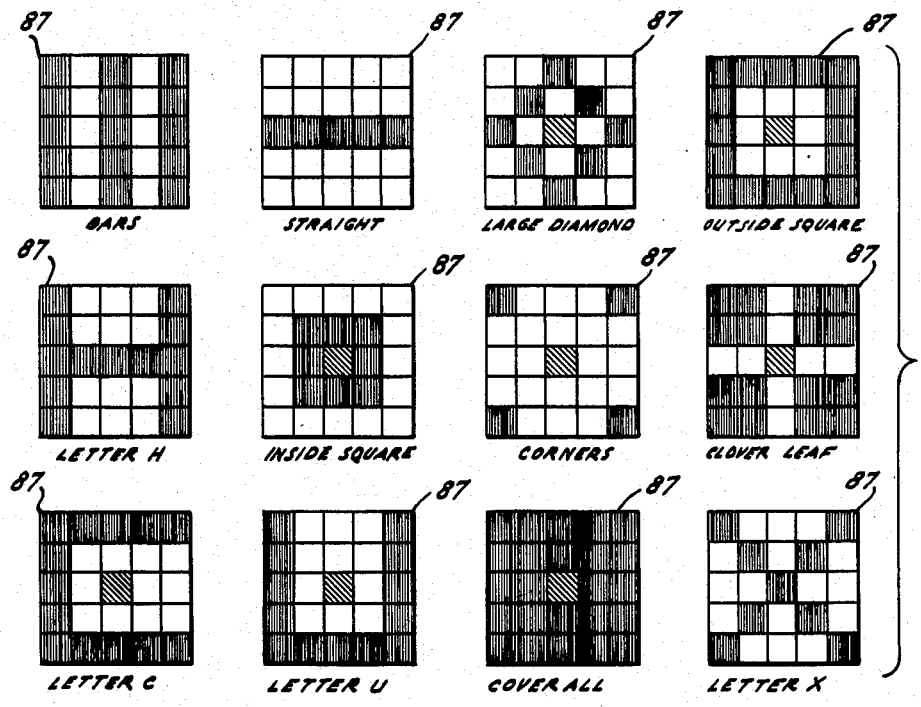
FIG. 4.

| BINGO | | | | |
|---|---|---|---|---|
| 00 | 05 | 0A | 0E | 13 |
| 01 | 06 | 0B | 0F | 14 |
| 02 | 07 | FREE SPACE | 10 | 15 |
| 03 | 08 | 0C | 11 | 16 |
| 04 | 09 | 0D | 12 | 17 |

89

91 (REGULAR BINGO OR CORNERS: 13 WAYS; 5 DOWN; 5 ACROSS; 2 DIAGONAL; 1 CORNERS)

F1 ADD 00 01 02 03 04 F1 05 06 07 08 09 F1 0A 0B 0C
0D F1 0E 0F 10 11 12 F1 13 14 15 16 17 F1 00 05
0A 0E 13 F1 01 06 0B 0F 14 F1 02 07 10 15 F1
03 08 0C 11 16 F1 04 09 0D 12 17 F1 00 06
11 17 F1 04 0B 0F 13 F1 00 04 13 17 F1 FF 93 93 93 93 95

LEGEND:

F1 = SUBMASK DETERMINATE "OR" SEPARATOR

FF = END OF MASK

COMPARE PROCESS FLOW

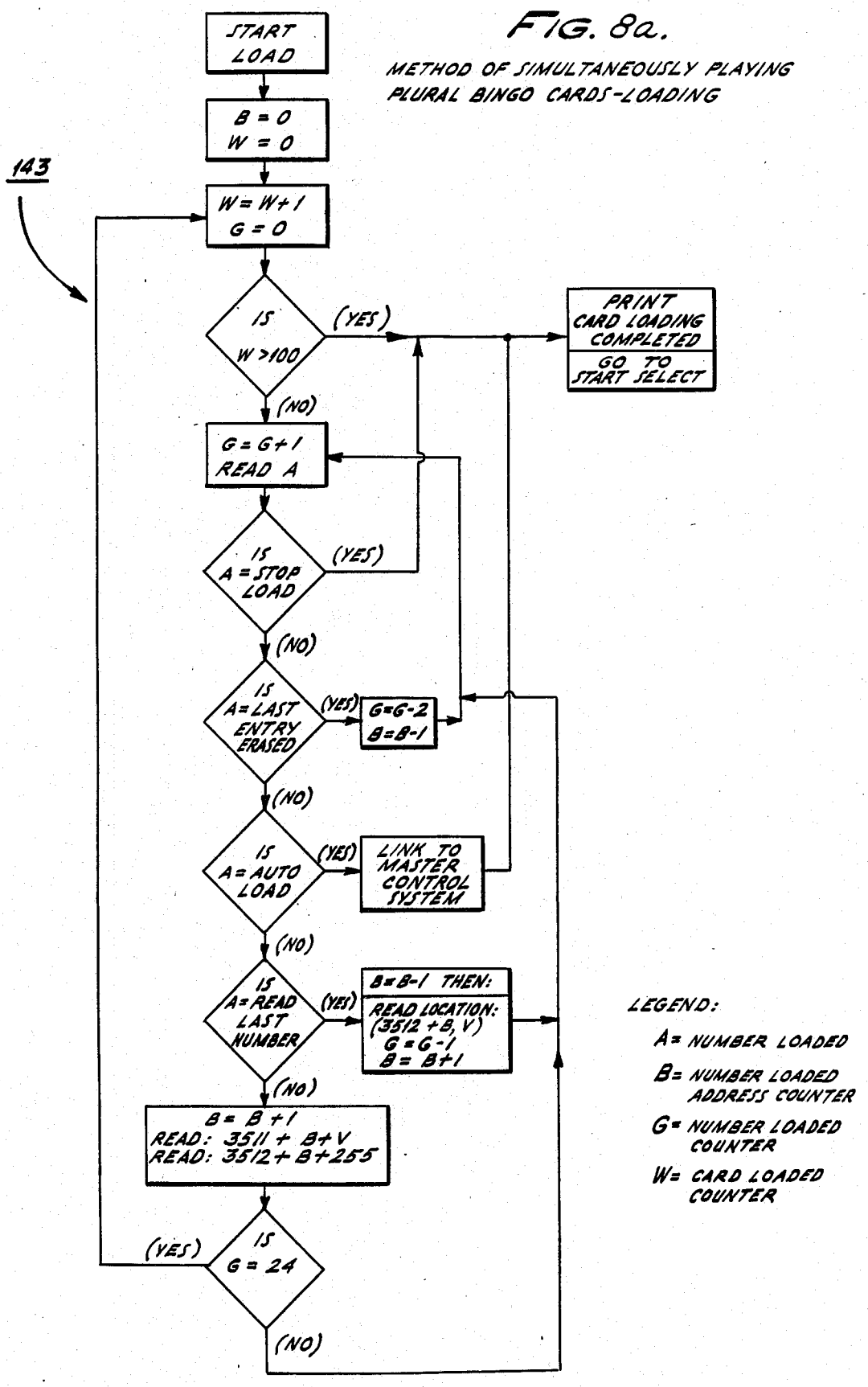
FIG. 8a.
METHOD OF SIMULTANEOUSLY PLAYING PLURAL BINGO CARDS-LOADING
143
START LOAD
B = 0
W = 0
W = W+1
G = 0
IS W >100
(YES)
PRINT CARD LOADING COMPLETED
GO TO START SELECT
(NO)
G = G+1
READ A
IS A = STOP LOAD
(YES)
(NO)
IS A = LAST ENTRY ERASED
(YES)
G=G-2
B=B-1
(NO)
IS A = AUTO LOAD
(YES)
LINK TO MASTER CONTROL SYSTEM
(NO)
IS A = READ LAST NUMBER
(YES)
B=B-1 THEN:
READ LOCATION: (3512 + B, V)
G = G-1
B = B+1
(NO)
B = B+1
READ: 3511 + B+V
READ: 3512 + B+255
IS G = 24
(YES)
(NO)
LEGEND:
A= NUMBER LOADED
B= NUMBER LOADED ADDRESS COUNTER
G= NUMBER LOADED COUNTER
W= CARD LOADED COUNTER

METHOD OF SIMULTANEOUSLY PLAYING PLURAL BINGO CARDS SELECTION

METHOD OF SIMULTANEOUS BINGO PLAYING - START PLAY

LEGEND:
B = NUMBER OF CALLED NUMBERS COUNTER
J = GAME CHANGE FLAG
C = CALLED NUMBER ENTERED FLAG
V = LAST CALLED NUMBER STORED

METHOD OF SIMULTANEOUSLY PLAYING PLURAL BINGO CARDS-PRINTING

LEGEND:

K=NUMBER AT ADDRESS 2816

P=COUNTER INCREMENTING ADDRESS LOCATION (XT)

N1= CARD NUMBER

N2 = NUMBER NEEDED

X = COUNTER INCREMENTING ADDRESS LOCATION (X2)

METHOD OF SIMULTANEOUSLY PLAYING PLURAL BINGO CARDS-ADD/CHANGE

FIG. 8g.
METHOD OF SIMULTANEOUSLEY PLAYING PLURAL BINGO CARDS - READING
LEGEND:
R = CARD NUMBER TO BE PRINTED
S = ADDRESS INCREMENT COUNTER
I = NUMBER ON CARD PRINTED
F = ADDRESS COUNTER
H = CALLED NUMBER PRINTED
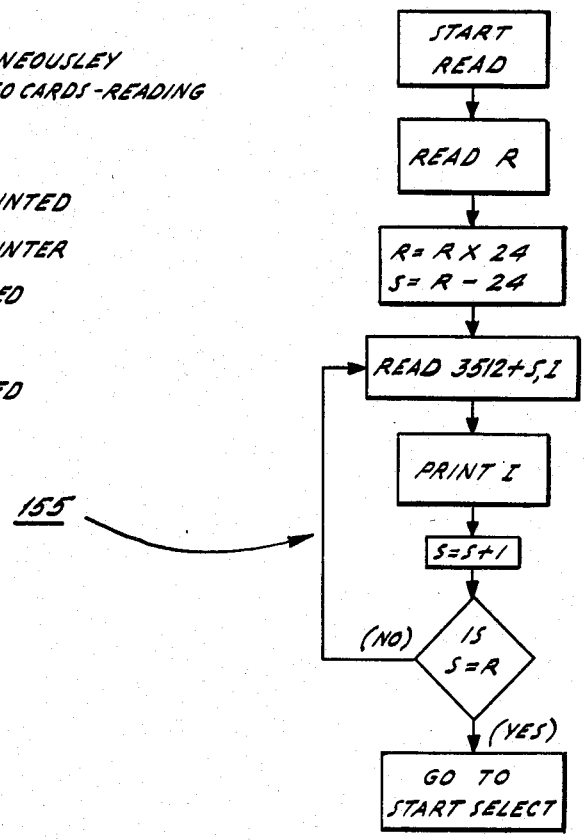
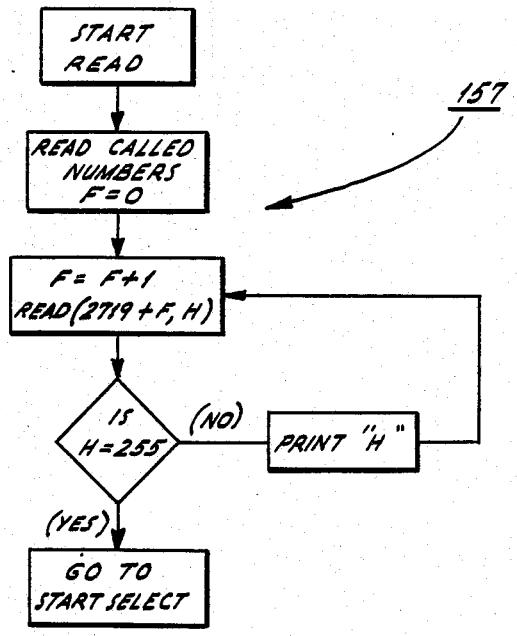
FIG. 8h.

BINGO GAME CALCULATOR WITH IMPROVED PROCESSING

BACKGROUND OF THE INVENTION

This invention relates to special purpose microcomputers and especially a microcomputers dedicated to help the user simultaneously "play" a large number of bingo cards, bingo card information being transformed from standard bingo cards to electronic data in the system.

Bingo is a game of chance which has been played for many years and is now actively played through the world. Many players enjoy simultaneously playing a plurality of bingo cards. As the number of cards played goes up the player is under added stress to place markers on each card. Player error increases as the number of cards increases.

The art appears presently devoid of devices whether electronic or electro-mechanical, which can be used by a player in playing an actual bingo game operated by a bingo parlor, and using, electronically, bingo cards actually handed-out or authorized for play by the bingo parlor.

Richardson, in U.S. Pat. No. 4,365,810, corresponding to UK No. 2,059,270, shows an electronic bingo gaming board. This device is an electronic bingo card. It includes a 5×5 electronic numerical display, which displays electronically entered numbers and relative positions making up a single bingo card being played. The device records the bingo "pattern" being played, i.e. bingo, four corners, "X", "H", etc. and records the called bingo numbers entered to signal a win.

This device uses electronic components, including a microcomputer to play a single bingo card. It is a single card dedicated device.

An object of the present invention is to provide a bingo calculator capable of simultaneous playing a plurality of bingo cards electronically.

A second object of this invention is to provide such a calculator which is implemented by a processor system capable of searching a plurality of bingo cards, electronically simultaneously stored therein, for a bingo win or near win, according to a designated chosen bingo game pattern entered.

Another object of this invention is to provide a single multipurpose, linear display, which displays operator entered information, processor generated operator prompt instructions and game determination announcements.

A further object of this invention is to provide a microprocessor chip bingo card and number search component operated under a compare program which increases the speed of searching and reduces electronic storage requirements for the processor system.

SUMMARY OF THE INVENTION

The objects of this invention are realized in a dedicated processor system incorporated into a portable battery powered unit having keyboard and display functions.

A large number of typical bingo cards, each containing 24 numbers arranged in columns and rows, can be entered, sequentially, by entering the numbers appearing on each card in order, either by sequential rows or sequential columns. Bingo game called numbers are then entered into the processor system after the designation of the type of bingo game being played has been entered.

A near bingo or bingo win announcement is displayed when either occurs.

User friendly instructions quiz the following: card entry, error correction, game selection, repeat display, display selective entries.

Selected processing steps are initiated upon signals from exclusively dedicated keyboard keys. Other information is entered from the number pad portion of the keyboard.

A liquid crystal display is incorporated to minimize power consumption. This display is accomplished by drive circuits. An 8-bit microprocessor chip which carries a specified size working memory is programmed to compute output instructions to the display; i.e. process bingo game information.

A stand alone read only memory, used as a temporary storage for the microprocessor, completes the architecture.

A processing sequence or algorithm provided by software loaded into the microprocessor completes the soft wiring of the system.

This algorithm includes a masking routine and a skip routing which greatly increases the speed of the game play and reduces storage requirements when implementing the basic compare program which compares called bingo game numbers to stored bingo card numbers, taking into consideration the designated or preselected type of bingo game being played by the bingo processor operator, i.e. the user.

The system has been preprogrammed i.e. loaded to play any of 50 different bingo games. These different bingo games include ordinary bingo, coverall, letter "X", four corners, parimeter, etc. Means are provided to select the particular game desired. The system can be expanded for additional bingo games as they are conceived by bingo players/bingo parlors by adding memory capacity, i.e. selecting a different version of the commercial microprocessor chip with more memory or custom building same.

Each programmed possible bingo game is represented by a distinct set of exclusively dedicated data fields organized in a specific structural arrangement in memory. The masking routine finds the selected bingo game and limits memory search during bingo game play, i.e. information processing, to the selected area of memory.

The skip routine capitalizes upon the unsuccessful number of comparisons to speed up comparison/uncomparison processing. This routine also keeps track of the number of successful comparisons to signal "a one number to bingo" and a "bingo win" situation.

Winning card and near win card readout is available.

Communication capabilities are included for transferring information to and from an unrelated computer or personal computer or central computer.

Plug in electronic cards containing preprogrammed bingo cards information can be connected to load the system. Likewise, a player error checking circuit can be connected to the system. A Braille keyboard can be added. A voice synthesizer with vocal output can also be connected.

DESCRIPTION OF THE DRAWINGS

The advantages, features and operation of the invention will become apparent from a reading of the followig detailed description in connection with the accompanying drawings in which like reference numerals refer to like elements and in which:

FIG. 1 is a plan view of the calculator invention case;

FIG. 4 is a sampling of 12 of a plurality of possible bingo gam patterns playable on the calculator invention;

FIGS. 8*a*–8*h* are operational flow representations of the loading, selection, play, print, add, change, and read processes carried out by the calculator invention.

DETAILED DESCRIPTION OF THE INVENTION

Figure 2:
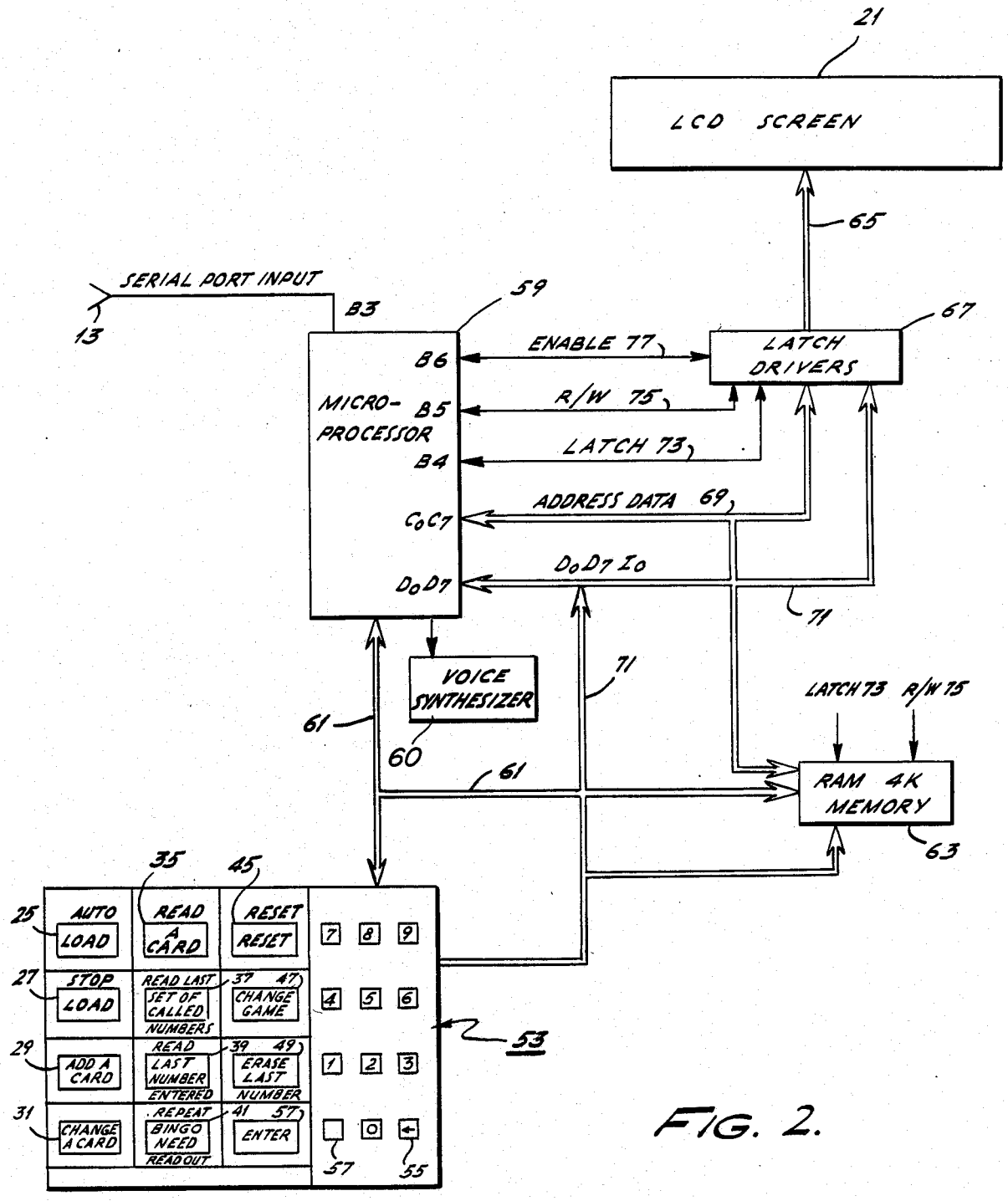
FIG. 2 is a block diagram of a circuitry implementation for the calculator invention.

A minicomputer system is built-up and customized to monitor and analyze bingo games which can be programmed into the system according to a soft wired or hard wired processing structure, thereby allowing a player to simultaneously play a large number of bingo cards with user friendly communication and announcement of calculator operations as well as bingo win and near bingo win.

The system 10 is housed in a case 11, FIG. 1. This case 11 includes a serial port 13 for automated data entry and an AC adaptor 15 along one side wall thereof. A power switch 17 is located on the top face of the case 11. Adjacent to this power switch 17 is a low battery voltage indicator light 19.

Positioned at a prominent location on the top deck of the case is a liquid crystal display screen 21. This display screen 21 provides alpha-numeric information in a linear fashion and in a single line readout. This screen 21 however could be expanded to a plurality of lines of readout with slight modification and is contemplated to be within the scope of the present invention.

The case also includes a dedicated instruction keyboard pad divided into three columns of four keys each. The first column is dedicated to load function keys 23 and includes an automatic load instruction key 25, a stop load instruction key 27 and add-a-card instruction key 29 and a change card instruction key 31. A second column is dedicated to load read keys 33. This column includes a read-a-card instruction key 35, a read-last-set of called numbers instruction key 37, a read-last-number entered instruction key 39 and a repeat readout instruction key 41. The last column is dedicated to play keys 43. This column includes a reset instruction key 45, a change game pattern instruction key 47, and an erase last number instruction key 49 and an enter instruction key 51.

A numeric keyboard pad 53 containing ten keys numbered 0-9 is located adjacent the dedicated instruction keyboard pad columns 23, 33, 43. This numeric keyboard pad 53 includes an eleventh key 55 being a backspace key and a twelfth key 57 being a blank or blank space key.

The circuitry for the calculator 10 housed within the case 11 is shown in FIG. 2. In the soft-wired embodiment the arithmetic/control/calculator circuitry is embodied within a microprocessor chip 59 as available in the market place from such suppliers as Texas Instruments Corporation, Model TMS 7020. This microprocessor chip 59 contains a 4K bit memory (read only memory) ROM. It is an 8 bit microcomputer in CMOS technology. Other microcomputers available in the market place can be substituted for this chip 59 including other models supplied by Texas Instruments, such as model TMS 7040 which has larger on chip program memory. Serial port 13 is an input to this microprocessor 59. The dedicated instruction keyboard keys 25, 27, 29, 31, 35, 37, 39, 41, 45, 47, 49, 51 are also connected with the numeric keyboard pad 53 and the backspace and blank keys 55, 57 through a first data bus 61 to the microprocessor 59, this data bus 61 being capable of passing information in either direction. Data bus 61 is also connected to a random access memory 63, this RAM 63 is of the type commonly available in the market place and has a 4K bit capacity. The liquid crystal display screen 21 is connected through a data bus 65 to a plurality of latch drivers 67. These latch drivers 67 are the type which are commonly available in the market place for driving liquid crystal displays 21. A voice synthesizer 60 can also be driven from the microprocessor 59 to provide audible movements.

An address data bus 69 connects the microprocessor 59 to the plurality of latch drivers 67 and the RAM memory 63. A bingo number data bus 71 interconnects the numeric keyboard pad 53 and the microprocessor 59 and the latch drivers 67 and RAM memory 63.

While specific instructions are transferred via the instruction data bus 61, and address information is transferred via the address data bus 69, and bingo number information is transferred via the data bus 71; and system signals, such as latching, read writing and enabling are transferred via dedicated hard wired inner connections 73, 75, and 77, respectively.

Figures 3, 5:
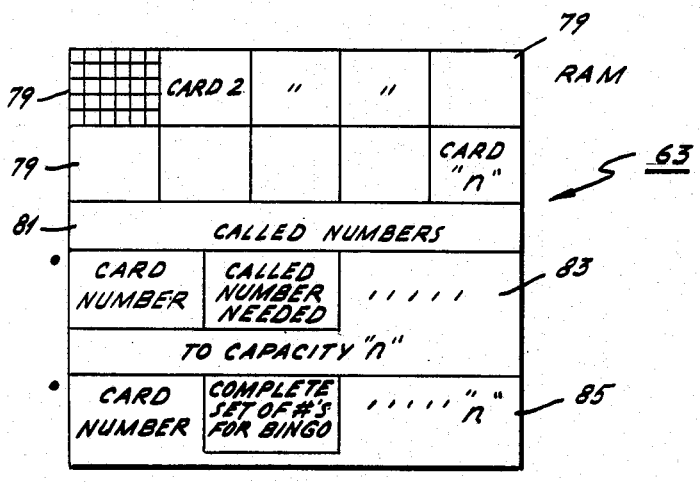
FIG. 3 is a memory map for the RAM memory element of FIG. 2.
FIG. 5 is a representation of entering a bingo card into the calculator memory for play.

FIG. 3 shows a map for the RAM memory 63 wherein various locations in that memory 63 are reserved and dedicated for specific types of information. This RAM memory 63 contains a first plurality of sections or fields 79 for holding bingo card information, specifically the numbers by row and column from each bingo card entered. These fields 79 are set up with an address and an identification for each card so that card 1, card 2, through card "n" can be easily located and read.

A second area 81 of this RAM memory 63 is reserved for called bingo numbers. This second area 81 needs only to be large enough to hold 75 numbers, the total of called bingo numbers that are possible in a given bingo game.

A third area 83 of the RAM memory 63 is reserved for storing the identification of a bingo card which is determined to need but a single additional bingo number for a "win", as well as, the identification of that bingo number needed for a win. Typically card identification is stored by card number. The capacity of this third section 83 of the memory is sufficient to hold the total number of cards "n" playable by the calculator 10. In one embodiment this is 50 cards. In a second embodiment it is 100 cards.

A fourth area 85 of the RAM memory 63 is reserved for card number identification information, as well as, the complete set of called numbers appearing on that particular card for a bingo win. This field also is large enough for "n" entries, as there may be a plurality of concurrent bingo winners at any given time.

FIG. 4 shows twelve examples of bingo winning patterns for twelve of the possible many bingo games for which the invention can be programmed either by soft-wiring or hard-wiring to play. The patterns 87 include beside straight bingo, bars, letter H, letter K, letter C, letter U, outside square, large diamond, clover leaf, corners, letter X, and cover all.

FIG. 5 shows in graphical presentation the method for reducing the information from a sample bingo card 89 into RAM 63 memory. This card is entered with the numbers appearing on the card in sequence either by entering the numbers column by column from left to right and from top to bottom, preferably, or by entering the numbers row by row from top to bottom reading from left to right. The numbers from the bingo card 89 once registered into the invention are entered into the fields 79 of the RAM 63 according to each of the possible type of bingo games the invention has been programmed to play. The particular bingo game i.e. the pattern 87 of FIG. 4 is then chosen and its location in the RAM memory 63 is identified.

The chart 91 of FIG. 5 shows the storage of the bingo card numbers from the card 89 for playing regular bingo or four corners bingo. The chart 91 is a storage of the bingo numbers from the card 89 according to a "mask" which represents the bingo game winning pattern selected to be played. Each bingo card storage sections or field 79 in the RAM memory 63 contains the numbers from a given bingo card, such as card 89 stored in a plurality of ways each way being a particular bingo win combination. Each bingo win combination, as the example 91 of FIG. 5 includes a memory address 93 represented by the circled "F1". This address 91 is a sub-mask determination "or" separator between the possible combination of ways for winning bingo. To win at regular bingo or four corners, as represented by the mask 91 chart which represents a collection of 13 sub-masks, represents the 13 different ways for winning at regular bingo or four corners, i.e. five different columns down, five different rows across, two different diagonal lines and a single four corner combination. Each sub-mask 91 as it is represented by the numbers recorded on the chart 91 following address or separator 93 is an individual combination from the bingo card 89 representing a particular win. The flag "FF" surrounded by a rectangle 95 represents an end to the entire mask comprising the 13 sub-masks.

In performing a compare or search for a bingo win or a compare or search for a bingo card present, the particular pattern chosen to be played i.e. the particular bingo game played is flagged in each field 79 of the RAM memory 63. Then a comparison is made only with the called bingo number and the stored selected mask and its attendant sub-masks.

As an example, if the invention were playing but a single bingo card, that card 89 of FIG. 5 and were playing regular bingo, the chart 91 would represent the mask selection for that game, and the called numbers would be compared against the sub-masks 93 in sequence from the beginning to the end comparing each of the 13 sub-masks against the bingo numbers called to determine a bingo win or near win.

A near win of course could be easily determined when all of the numbers within a given sub-mask compare with a called number except one and that entire sub-mask has been interrogated as indicated by the search reaching the next sub-mask separator 93.

The searching of a particular mask and its attendant submask can be expedited once a determination has been made that no additional information is necessary during a particular search of a sub-mask once two missing numbers or "non-compares" are determined. The invention here declares a win to the player or declares that the bingo card needs only one additional number for a win. The need of two or more numbers is of little interest to the bingo card player. The search of a given mask and its sub-mask therefore can be expedited by skipping to the next sub-mask in a sequence when two non-compares are determined for a particular sub-mask. This reduces competition and search time considerably.

Figure 6:
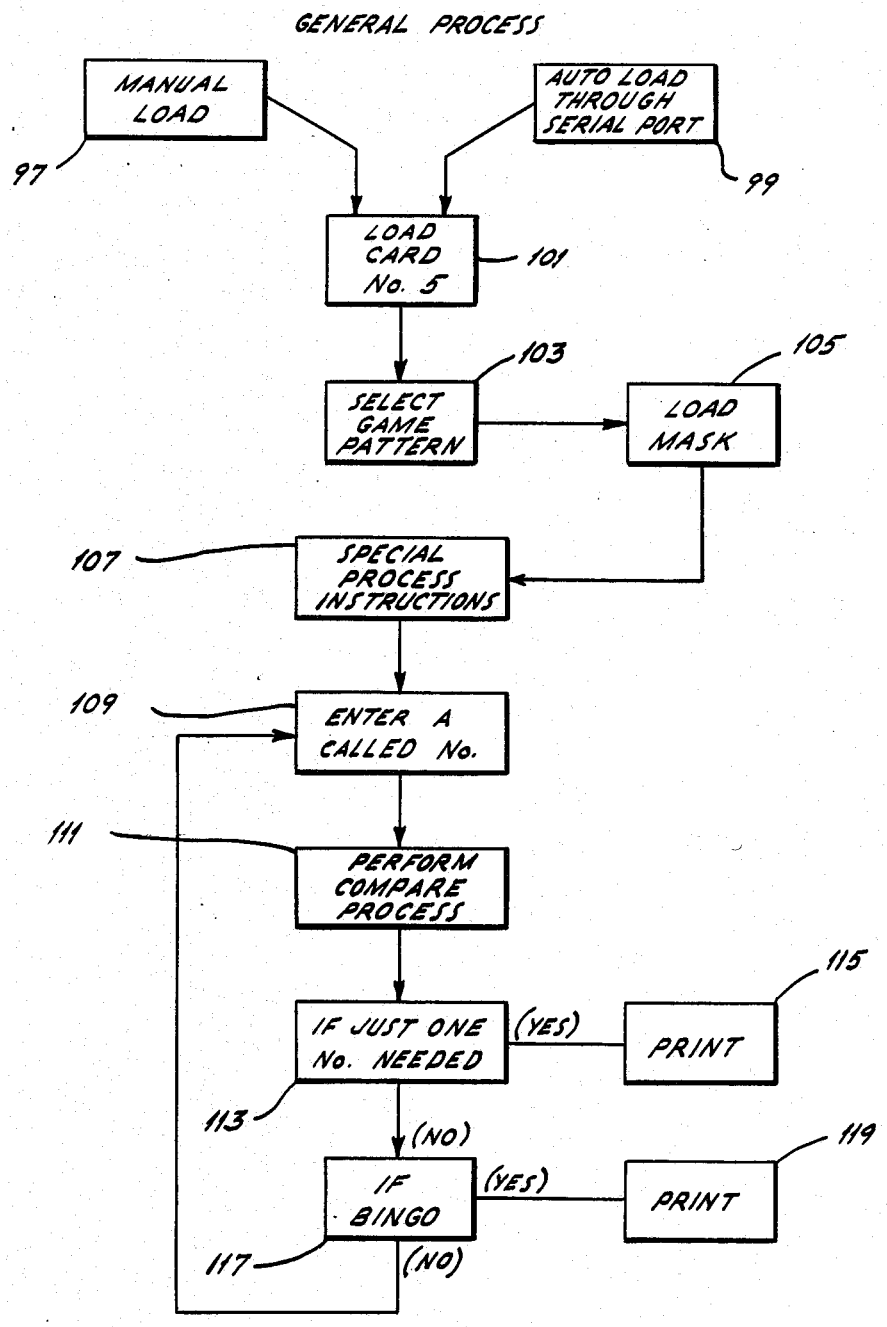
FIG. 6 is a flow operation representation of the basic play process carried out by the calculator.

The general process by which the bingo calculator operates is shown in a diagramatic representation in FIG. 6. Information is entered into the invention either via a manual loading, step 97, by the player utilizing the key pads, or by an auto load, step 99, through the serial port 13. Following the loading of these cards, step 101, a game pattern selection is made, step 103. This game pattern selection, step 103, causes the mask necessary to play that game to be indexed into the game, step 105. Special process instructions are then carried out, step 107. Such process instructions can be anything from reset to changing game to reading last card entered.

Once the special process instructions are carried out the called bingo numbers are entered, step 109, sequentially. With each bingo card called number entered a search and compare process, step 111, is carried out. When a bingo card is determined to need only one additional number, step 113, the identity of this card and the number needed is printed, step 115, on the display screen 21. If a bingo win is determined, step 117, for a particular card, this bingo win is also printed out, step 119, as well as the card identify and the winning bingo numbers. Once this, step 117, has been accomplished additional searching is performed for other bingo cards stored. In this manner, the completed process is repeated for the next called bingo number entered as was begun with step 109.

Figure 7:
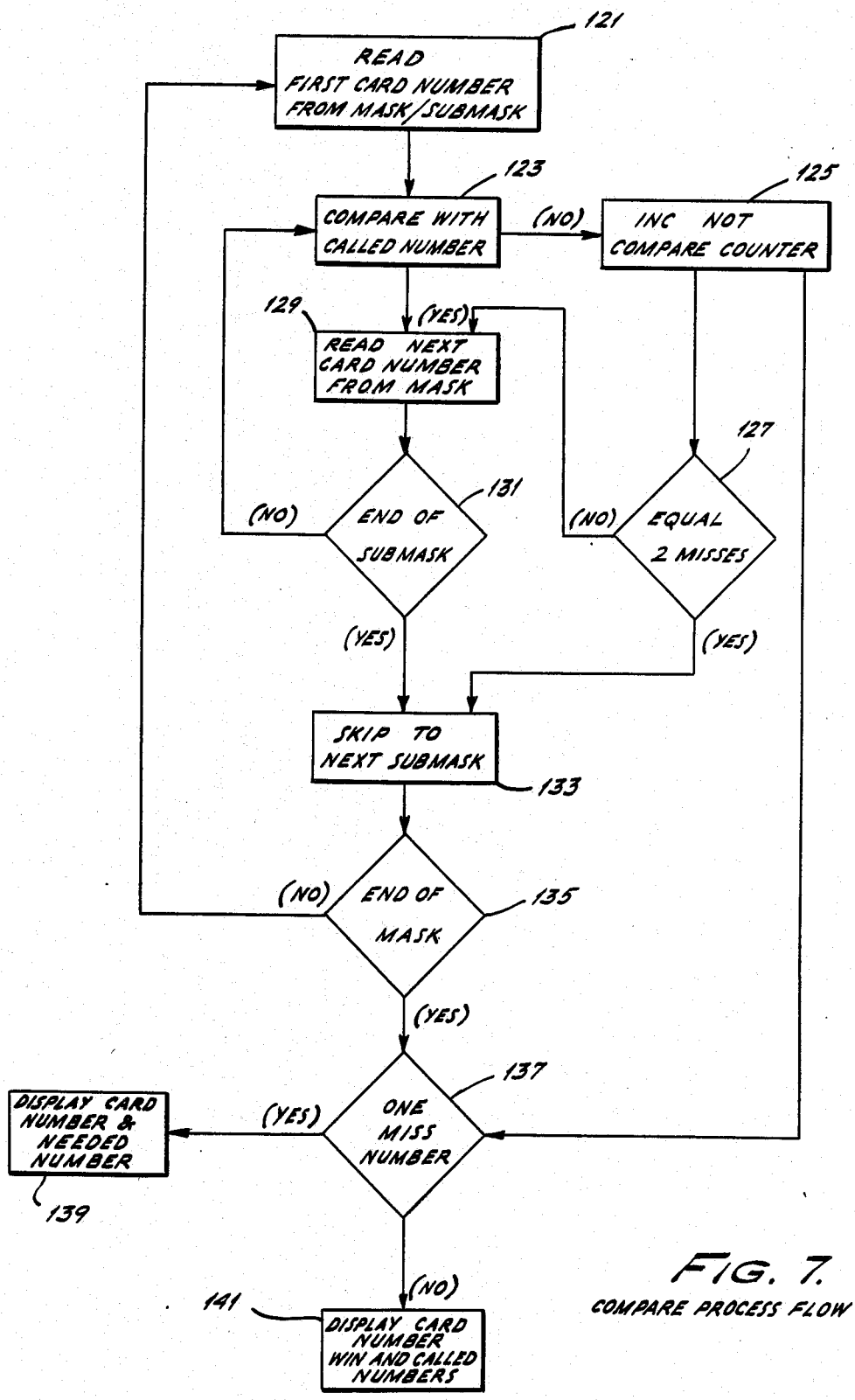
FIG. 7 is a flow operation representation of the compare process and masking process carried out under the direction of the microprocessor element of FIG. 2.

The masking and skip routines for the compare process carried out by the calculator are illustrated in the method or process flow chart of FIG. 7. A first card number is read from the mask or sub-mask, step 121. This number is compared with the instantaneous called bingo number step 123. If there is no comparison made then a compare counter is incremented by 1, step 125. If the number of misses or non-comparisons equals to "two", step 127, the process skips to the next sub-mask, and if it does not equal two misses then the next card number is read from the mask, step 129. When the end of the sub-mask is reached, step 131, the process then skips to the next sub-mask, step 133. If this sub-mask end has not been reached then the comparison is carried out to the next called number as with the previous process step 123. Once the end of a particular mask is reached, step 135, a determination is made if there has been only one missed or non-comparison, step 137. If this is so, then the card identification and the needed remaining bingo number are printed, step 139. If it is not so, the reason that it is not so and a completion of the mask has been accomplished is that a total comparison has been made and the winning bingo card identification is displayed as well as all of the winning bingo numbers step 141. Since it is desirable to have each bingo card checked for every win or near win situation, as is shown in FIG. 7 the present invention will continue to read through every submask for a given bingo card before skipping to the next card submask.

FIG. 8*a* illustrates the process step flow in block diagram presentation for the loading process carried out by the microprocessor 59 under the direction of a program held in its memory. Index registers are set up including register A for the bingo number loaded, register B for the address counter of the bingo number loaded, register V for the last called number stored, register G for the counter indexing the total numbers of numbers loaded and a register W for a counter indexing the total numbers of cards loaded. This loading process 143 is self explanatory from a reading of the printed entries on the flow chart 143. As is shown in flow chart 143, 3512 is an arbitrary number to signify address location of the start of loaded numbers, 3511 is an arbitrary number to signify address location of the start for stored bingo card numbers, 255 is an arbitrary number to signify end of card numbers stored (i.e. its value is machine language symbol "FF"—signaling final address, stop compare and start over (see FIG. 5)). Thus 3512+B, V instructs reading of last number entered, 3511+B, V instructs that number V be inserted into the address 3511+B, and 3512+B, 255 instructs that the number 255 be inserted into the address 3512+B. The register G will equal 24 when the bingo card is completely loaded (i.e. each of the 24 spaces on a standard bingo card is assigned). When W>100 (i.e. 100 being an abitrary bingo card capacity of one embodiment of the present invention) or a load terminating command is selected, card loading is completed.

Figure 8B:
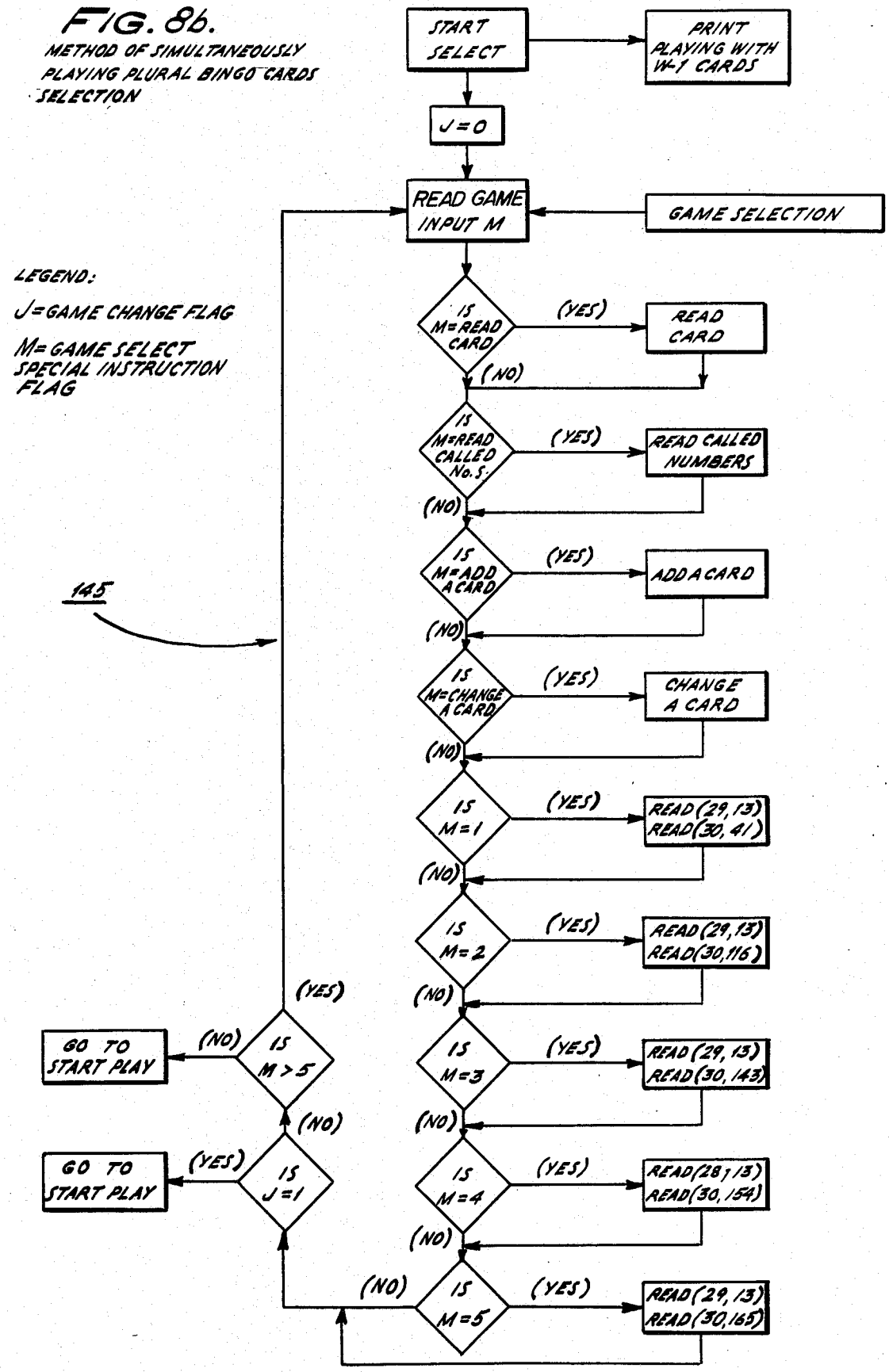

FIG. 8*b* shows a block diagram flow chart for the process of game selection, i.e. mask selection process 145 as carried out by the microprocessor 59 under the program instructions stored in its memory. A register J is established as a change game pattern flag and a register M is established as a special instruction game select flag for this selection process illustrated by the flow chart 145. As is shown in flow chart 145, each of the M register numbers is an arbitrary signal to select specific addresses of masks to play particular forms of bingo (e.g. see FIG. 5). Each of the masks corresponding to the various forms of bingo which may be played are located at specific arbitrary addresses (e.g. (29, 13)+(30, 41).

Figure 8C:
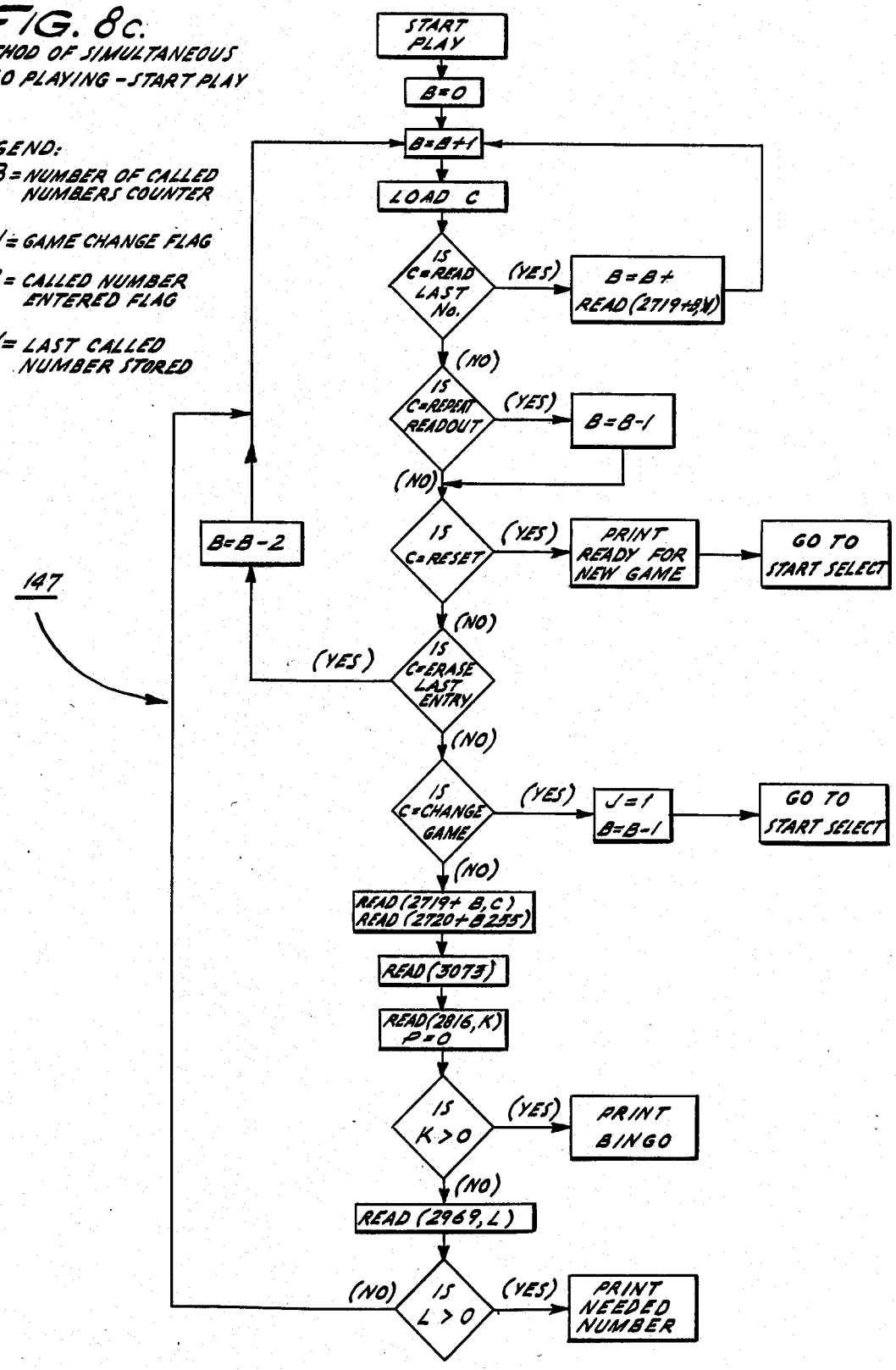

FIG. 8*c* shows the process steps carried out by the microprocessor 59 under the program contained in its memory for a playing steps flow chart 147. These process steps 147 utilize the previously established registers B, C, and J. Shown are the operational steps 147 as they are carried out and the decision making process for loading information going to other process routines such as selection 145 and printing 149, 151, when either a bingo win or a bingo number are needed. As is shown in flow chart 147, register P is a counter which increments by the address location and register L is the value at address 2969 which is the location of stored needed numbers and corresponding stored cards.

Figure 8D:
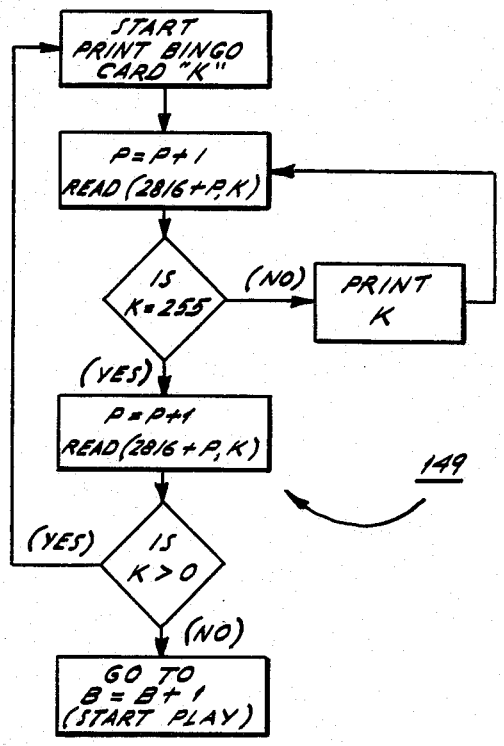
Figure 8E:
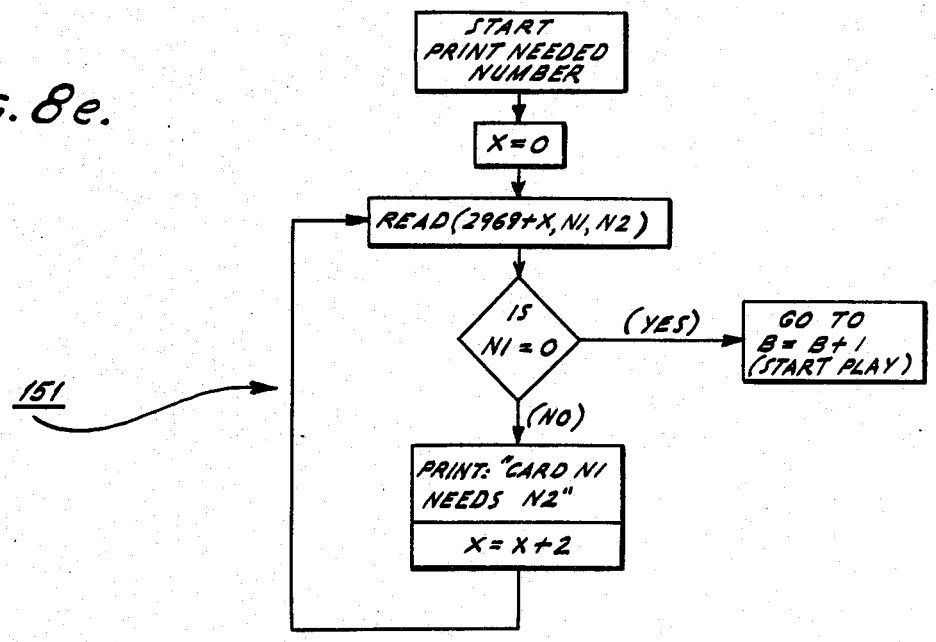

FIGS. 8*d* and 8*e* show the process steps for printing, 149, 151. The printing sequence of operations are shown as FIG. 8*d* for printing, flow chart 149, a specific bingo card "K", as a winning bingo card; and FIG. 8*e* shows the process steps 151 for printing a single specific bingo card number needing one additional bingo number to win. A "K" register is established for an address allocated within the RAM memory 63. A "key" register is established as a counter for incrementing the address location. An "N1" register is established for the card number while an "N2" register is established for the bingo number needed. An "X" register is established for use in holding a counter incrementing address locations. A step saving provision shown in FIG. 8*e* is identifying a counter location at address 2969+X along with immediately subsequent addresses, "N1" and "N2" (i.e. this computer is capable of reading two consecutive addresses).

Figure 8F:
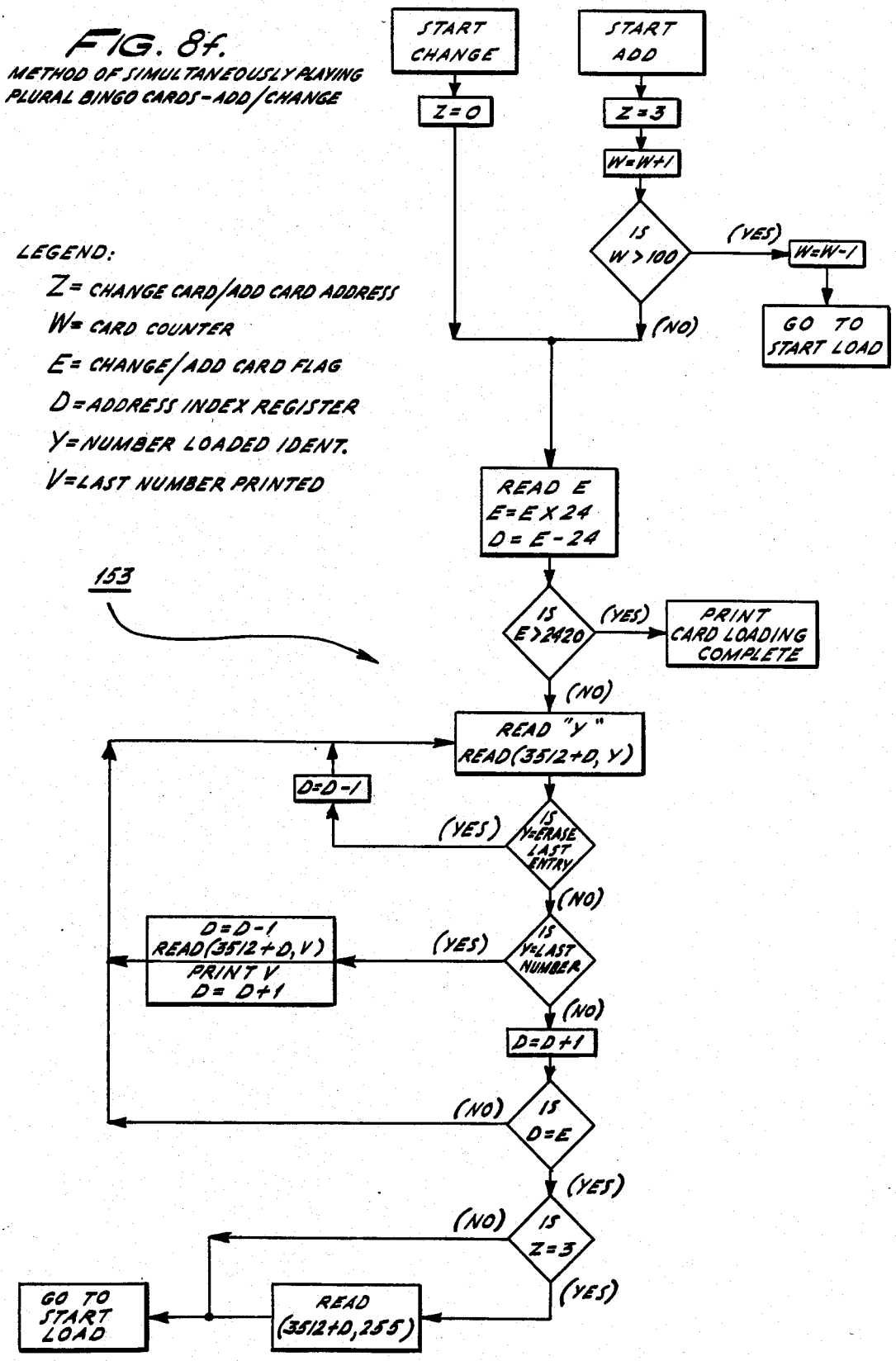

FIG. 8*f* illustrates the process flow 153 for the method of changing or adding a bingo card to memory as carried out by the microprocessor 59. These add or change steps, as illustrated by the flow chart 153, utilize an established register "Z" which holds the identification of the change card or add card address. A register "W" has a card counter; a register "E" has the change or add a card flag; a register "D" is used as the address index register, a register "Y" holds the number loaded identification and it also utilizes the previously existing register "V" for the last called number stored or printed. The number 24 corresponds to the number of total possible spaces on a standard bingo card. Accordingly bingo numbers for each stored bingo card are located within increments of 24 spaces. This process 153 is initiated upon a change or an add a card initiation instruction and results in a direction to shift the microprocessor to the load process 143 or the print process 149 wherein the identity of the card loaded and the announcement that card loading has been completed is accomplished.

FIGS. 8*g* and 8*h* show the read processes flow diagrams 155, 157, respectively, carried out by the microprocessor 59 under the program held within its memory. An "R" register is established for the card number to be printed, an "S" register is established as an address increment counter, an "I" register is established for the number of the card or on the card to be printed. An "F" register is established as an address counter and an "H" register is established for the called number to be printed. The number 24 corresponds to the number of total possible spaces on a standard bingo card. Once the respective reading processes, flow diagrams, 155, 157 are carried out and any printing is accomplished, the routines 155, 157 exit into the selection process 145 illustrated by FIG. 8*b*.

Figure 9:
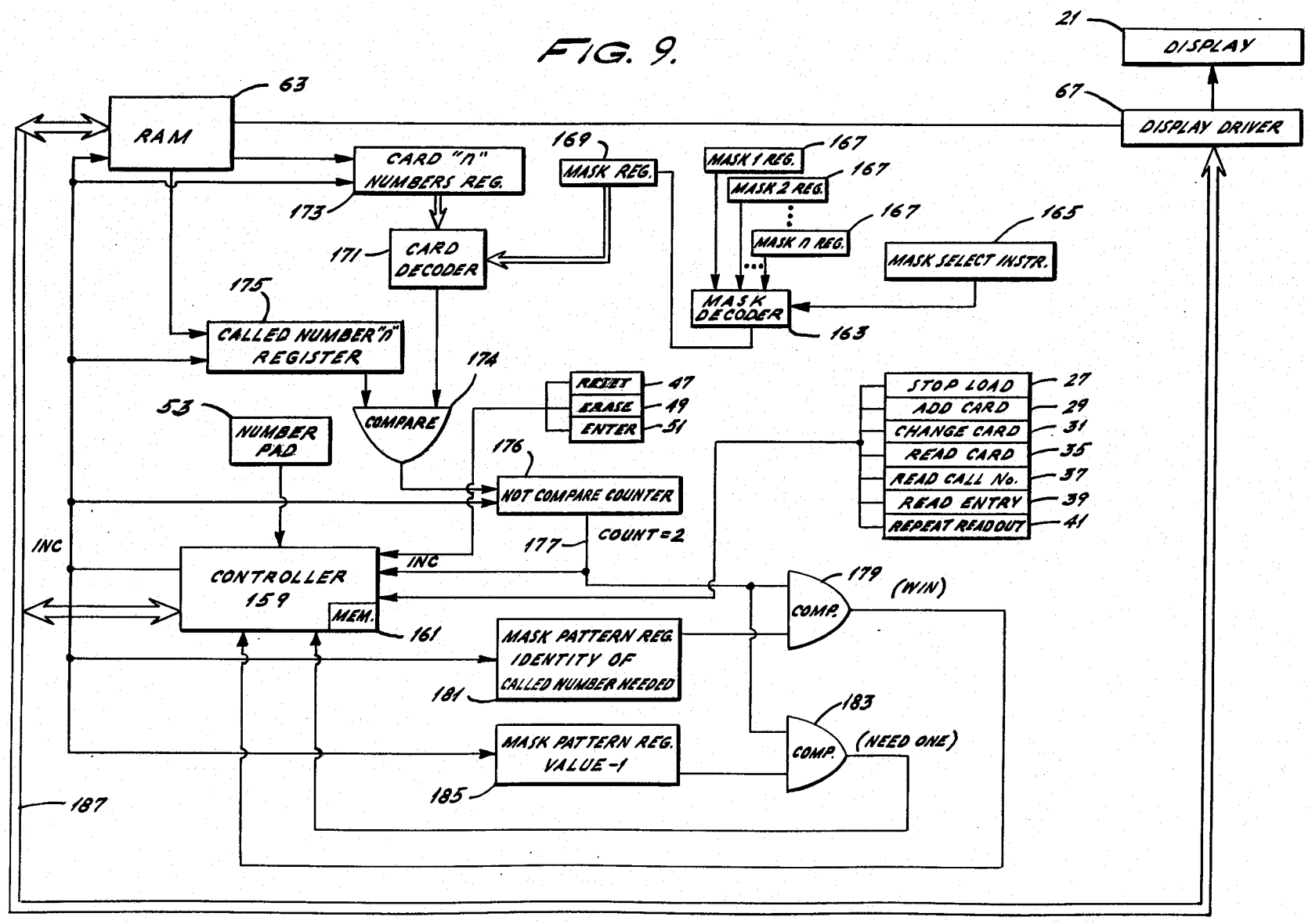
FIG. 9 is an alternate hardware embodiment of the microprocessor element of FIG. 2.

The general process routine of FIG. 6, as well as the compare process routine of FIG. 7, can be carried out by alternate circuitry to the microprocessor 59. This alternate circuitry is illustrated in FIG. 9. Here the identical liquid crystal display 121 is utilized as well as the plurality of latch drivers 67. The same numerical pad 53 is utilized as well as the respective dedicated instruction keys for stop load 27, add card 29, change card 31, read card 35, read last called number entered 37, read least number entered 39, repeat read out 41, reset 47, erase 49 and enter 51 instructions. The same read RAM memory 63 may also be utilized.

This circuit can use a simple controller 159 which can be selected from any of those in the market place including a Commodore MOS, Inc. Model 6502, which can have on the chip a memory or working registers 161 closely connected thereto.

A mask decoder 163 receives an instruction from a mask select register 165 which enables one of a plurality of masks stored in a plurality of registers 167 connected to the mask decoder 163 to be loaded into a primary mask register 169. This primary mask register 169 is connected to a card decoder 171 which also receives information from a card "N" numbers register 173. This card "N" numbers register 173 receives information from the RAM 63 and is incremented via a signal line from the controller 159.

The output from the card decoder 171 is fed to a compare circuit 174 which also receives its other input from a called number register 175. This called number register 175 is incremented from the controller 159 and receives information from the RAM 63. The output of the compare circuit 174 is input to a not compare counter 176. This not compare counter 176 is also incremented from the controller 159. When the not compare count equals to "two", the counter output 177 goes high and acts to increment the controller 159, as well as, is connected to an input to a compare circuit 179. This compare circuit 179 receives an additional input from a mask pattern register 181 which contains the identify of the called number needed which has been received and loaded from the controller 159. The count equal to two output 177 from the counter 176 is also input to another comparator 183 which comparator 183 receives another input from a mask pattern register "value-less-one" register 185 which has been loaded from the controller 159. The output from the compare circuit 179 indicates a bingo win which is fed back to the controller and eventually results in a display 21 response. The output from the comparator 183 results in a need one number signal to the controller 159 which eventually results in a single number needed for a specific bingo card announgement on the display 21. A data bus 187 acts as the principal transfer pipeline for electronic information between the controller 159, the read only memory 63 and the display latch drivers 67.

The circuitry of the embodiment of FIG. 9 performs the compare and skip routine soft-wired into the microprocessor 59 in the first embodiment by programming the microprocessor 59 memory. It performs these routines or methods of operation by hard-wiring of circuit components.

As additional changes in the invention described above can be made without departing from the intent and scope thereof, thereby yielding additional embodiments of the invention, it is intended that the above description be read as illustrative of the invention, and not be read in the limiting sense.

What is claimed is:

1. A multiple bingo card, simultaneous play, electronic calculator, for playing a plurality of entered bingo cards according to an entered bingo game pattern having reduced memory requirements and increased calculating speed, comprising:

display means for displaying alpha-numeric information, said display means including a driver circuit connected thereto, said driver circuit controlling the information displayed;

a calculator circuitry connected to said display means driver circuit, said calculator circuitry including a plurality of working storage elements;

a dedicated instruction keyboard pad connected to said calculator circuitry and to said display means driver circuit;

a numeric keyboard pad connected to said calculator circuitry and to said display means driver circuit;

a memory chip for storing bingo card information and called bingo numbers information, said memory chip being connected to said calculator circuitry;

wherein said calculator circuitry storage elements include a storage location for the bingo game pattern selected to be played; and wherein said calculator circuitry places said bingo game pattern over said memory chip stored bingo card information and then compares called bingo numbers with each stored bingo card pattern number;

wherein said bingo game pattern selected forms a "mask," said mask limiting bingo card number search for each bingo card stored to patterns required for the particular bingo game selected, said mask being divided into a series of submasks each said submask corresponding to one possible winning bingo pattern; and wherein said calculator circuitry include means for skipping stored bingo card for comparison when two missed comparisons between called and stored bingo numbers for each submask of said mask are attained.

2. The calculator of claim 1 wherein said calculator circuitry directs said driver circuit to operate said display means to announce a near bingo win with bingo card identification and remaining single bingo card number needed when said comparison of a particular bingo card determines an all but one comparison with called numbers.

3. The calculator of claim 2 wherein said calculator circuitry directs said driver circuit to operate said display means to announce a bingo win with bingo card identification and winning bingo card numbers. When said comparison of a particular bingo card determines a complete comparison with called numbers.

4. The calculator of claim 3 wherein said display is a linear liquid crystal display, and wherein said driver circuit includes a plurality of latch drivers, one for each element of said liquid crystal display.

5. The calculator of claim 4 wherein said memory chip is a random access memory (RAM) connected to said calculator circuitry and to said plurality of latch drivers.

6. The calculator of claim 5 wherein said calculator circuitry is a microprocessor chip containing a working memory, said microprocessor chip being connected to said plurality of latch drivers, said RAM numeric keyboard pad and said instruction keyboard pad.

7. The calculator of claim 6 wherein said calculator circuitry includes:

a controller connected to said numeric keyboard pad and said instruction keyboard pad, said controller including a memory section, said controller being connected to said RAM and said plurality of latch drivers;

a first register connected to said RAM and to said controller;

a second register;

a first decoder connected to receive inputs from said first and second registers;

a second decoder connected on its output to load said second register;

a plurality of mask registers connected to said second decoder;

a mask select instruction register connected to said second decoder;

a third register connected to said RAM and to said controller;

a first compare circuit connected to the output of said third register and to the output of said decoder;

a not-compare counter connected to said first compare circuit output and incremented from said controller, the "two count" output from said not-compare counter being connected to said controller;

a second compare circuit connected to said "two count" output of said not-compare counter and having its output connected to said controller;

a mask pattern register for holding identify of the called number needed to win, said mask pattern register being incremental from said controller, said mask pattern register output being connected to a said second compare circuit input;

a second mask pattern register holding said mask pattern register value less one, said second mask pattern register being incremented from said controller; and a third compare circuit having a first input connected to said second mask pattern register and a second input connected to said "two-count" output from said not-compare register, said third compare circuit having its output connected to said controller.

8. The calculator of claim 7 wherein said first register holds, sequentially, bingo card numbers being compared with; wherein said second register holds mask pattern information; and wherein said third register holds, sequentially, called numbers for comparison.

9. A method of playing, simultaneously, a plurality of bingo cards according to a predetermined bingo game pattern on an electronic calculator allowing for reduced memory requirements and increased speed of comparisons, comprising the steps of:

first loading sequentially the numbers from a first bingo card to be played;

second loading sequentially the numbers from plural subsequent bingo cards, said second loaded cards being sequentially loaded;

selecting a game pattern;

making said first and second loaded bingo card numbers to make only those available for comparison which fulfill the selected game pattern;

entering each called bingo number when called;

searching each bingo card stored for comparison with each entered called number;

first determining a near comparison when a bingo card comparison needs but one more number;

first announcing the identification of said bingo card and said needed number when said determination is made;

second determining a bingo win when a bingo card comparison completes all bingo numbers-locations for a bingo win;

second announcing the identification of said bingo card and said winning numbers when a win is made; and including following the step of searching and before the step of first determining, the steps of:

keeping track of the number of non-comparisons made on each possible winning bingo pattern on each bingo card; and skipping to the next possible winning bingo pattern when two said non-comparisons are accumulated on each said possible winning bingo pattern.

10. The method of claim 9, wherein said first loading step includes storing each said loaded number for said first bingo card in a memory location dedicated to said first card; and wherein said subsequent loading step includes storing each said loaded number from each said subsequent bingo card in a respective memory location dedicated to each said subsequent card.

11. The method of claim 10 wherein said first announcing step includes displaying in alpha-numeric information said bingo card identification and said needed number.

12. The method of claim 11 wherein said second announcing step includes displaying in alpha-numeric information said winning bingo card identification and said winning bingo numbers.

13. The method of claim 12 wherein said first and second loading steps each include loading each of said bingo card numbers sequentially by row, from left to right and top to bottom of said numbers on each said bingo card.

14. The method of claim 13 wherein said first and second loading steps each include loading each said bingo card numbers, sequentially by column from top to bottom and left to right of said numbers on each said bingo card.

* * * * *